US009227773B2

(12) United States Patent
Nakamura et al.

(10) Patent No.: US 9,227,773 B2
(45) Date of Patent: Jan. 5, 2016

(54) PACKING CONTAINER AND COVER PACKAGE

(71) Applicant: NINTENDO CO., LTD., Kyoto (JP)

(72) Inventors: Kosuke Nakamura, Kyoto (JP); Yui Ehara, Kyoto (JP)

(73) Assignee: NINTENDO CO., LTD., Kyoto (JP)

( * ) Notice: Subject to any disclaimer, the term of this patent is extended or adjusted under 35 U.S.C. 154(b) by 0 days.

(21) Appl. No.: 14/330,237

(22) Filed: Jul. 14, 2014

(65) Prior Publication Data

US 2015/0225157 A1 Aug. 13, 2015

(30) Foreign Application Priority Data

Feb. 7, 2014 (JP) ..... 2014-022068

(51) Int. Cl.
*A45C 11/00* (2006.01)
*B65D 75/36* (2006.01)
*B65D 25/54* (2006.01)

(52) U.S. Cl.
CPC ..... *B65D 75/367* (2013.01); *B65D 25/54* (2013.01); *B65D 75/36* (2013.01)

(58) Field of Classification Search
CPC ..... A45C 11/00; A45C 2011/001–2011/003; B65D 25/54; B65D 75/366; B65D 75/377; B65D 81/365; B65D 85/38
USPC ..... 206/305, 320, 457–458, 459.5, 206/461–471
See application file for complete search history.

(56) References Cited

U.S. PATENT DOCUMENTS

| | | | | | |
|---|---|---|---|---|---|
| 2,893,546 | A * | 7/1959 | Kendall et al. | ..... | 206/471 |
| 3,307,281 | A * | 3/1967 | Mateo | ..... | 206/457 |
| 4,957,202 | A * | 9/1990 | Yoshiki et al. | ..... | 206/734 |
| 5,325,961 | A * | 7/1994 | Ford et al. | ..... | 206/470 |
| 5,386,909 | A * | 2/1995 | Spector | ..... | 206/457 |
| 6,216,866 | B1 * | 4/2001 | Schoenberg | ..... | 206/461 |
| 2004/0040880 | A1 | 3/2004 | Grosskopf | | |
| 2007/0051653 | A1 | 3/2007 | Tilton | | |

FOREIGN PATENT DOCUMENTS

| | | |
|---|---|---|
| JP | 11-177661 | 7/1999 |
| JP | 3073242 | 11/2000 |
| JP | 2010-226203 | 10/2010 |
| JP | 2010-228773 | 10/2010 |
| JP | 2013-000164 | 1/2013 |
| JP | 2014-055007 | 3/2014 |

OTHER PUBLICATIONS

Jul. 16, 2015 Extended European Search Report issued in European Application No. 14191335.0.

* cited by examiner

*Primary Examiner* — Bryon Gehman
(74) *Attorney, Agent, or Firm* — Nixon & Vanderhye P.C.

(57) ABSTRACT

A non-limiting example packing container includes a first member and a second member, and two pieces of covers (contents) which constitute a part of a main body of a game device are stored by the first member and the second member while being arranged vertically. In the packing container, an interval between the two pieces of covers and parts of upper and lower portions of the two pieces of covers are made transparent. Accordingly, if an imitation which imitates the game device is installed into a concave portion which is formed in the rear of the packing container that stores the covers, the imitation can be seen through the parts made transparent, whereby a state like a state that the two pieces of covers are attached to the game device can be seen.

16 Claims, 16 Drawing Sheets

PACKING CONTAINER AND COVER PACKAGE

CROSS REFERENCE OF RELATED APPLICATION

The disclosure of Japanese Patent Application No. 2014-022068 filed on Feb. 7, 2014 is incorporated herein by reference.

FIELD

This application describes a packing container and a cover package, packing a cover which constitutes a part of a main body of an arbitrary device or covers a part of the main body.

SUMMARY

It is a primary object of an embodiment to provide a novel packing container and a cover package.

Another object of the embodiment is to provide a packing container and a cover package, capable of easily knowing a desired combination.

A first embodiment is a packing container which packs a cover which constitutes a part of a main body of an arbitrary device or covers the part of the main body. A storing portion stores the cover. An installing portion installs an imitation that imitates at least a part of the device. In the packing container, at least a part of an area except an area storing the cover is made transparent in a front view when the cover is stored in the storing portion, whereby at least a part of the imitation is visible in a case where the imitation is installed in the installing portion.

According to the first embodiment, it is possible to see a state like a state that the cover that is stored in the storing portion is attached to the device. Accordingly, it is possible to easily know a desired combination of the cover and the device.

A second embodiment is a packing container according to the first embodiment, wherein the installing portion has a concave portion for installing the imitation, and at least the concave portion is made transparent in the front view.

According to the second embodiment, since there is provided with the concave portion that is transparent in the front view, it is possible to see a state that the cover is attached to the device from the front only by fitting the imitation into the concave portion.

A third embodiment is a packing container according to the second embodiment, wherein the concave portion is made transparent in a side view.

According to the third embodiment, it is possible to see a state that the cover is attached to the device from the side only by fitting the imitation into the concave portion.

A fourth embodiment is a packing container according to the first embodiment, wherein the main body of the device has a first housing, a second housing and a coupling portion which couples the first housing and the second housing to each other. The cover includes a first cover which constitutes a part of the first housing or covers the part and a second cover which constitutes a part of the second housing or covers the part. The storing portion stores the first cover and the second cover while arranging the first cover and the second cover at an interval of a width corresponding to a width of the coupling portion.

According to the fourth embodiment, when the imitation is installed, it is possible to see through the coupling portion of the device an appearance like a case where the first cover and the second cover are attached to the device.

A fifth embodiment is a packing container according to the fourth embodiment, wherein at least the interval between the first cover and the second cover is made transparent.

According to the fifth embodiment, as similar to the fourth embodiment, it is also possible to see through the coupling portion of the device an appearance like a case where the first cover and the second cover are attached to the device.

A sixth embodiment is a packing container according to the fourth embodiment, wherein a side that the first cover and the second cover do not approach each other is made transparent. Accordingly, the imitation can be also seen through the packing container in the side that the first cover and the second cover do not approach each other.

According to the sixth embodiment, it is possible to see an overview that the first cover and the second cover are attached to the device, for example.

A seventh embodiment is a cover package including a cover which constitutes a part of a main body of an arbitrary device or covers the part of the device and a packing container which packs the cover, wherein the packing container comprises a storing portion which stores the cover and an installing portion that installs an imitation that imitates at least a part of the device, and by making at least a part of an area except an area storing the cover is made transparent in a front view when the cover is stored in the storing portion, at least a part of the imitation is visible in a case where the imitation is installed in the installing portion.

According to the seventh embodiment, as similar to the first embodiment, it is also possible to easily know a desired combination of the device and the cover.

The above described objects and other objects, features, aspects and advantages of the embodiments will become more apparent from the following detailed description when taken in conjunction with the accompanying drawings.

BRIEF DESCRIPTION OF THE DRAWINGS

FIG. 2 is closed, and FIG. 3(A) is a view viewing the packing container from the front and FIG. 3(B) is a cross-sectional view at a line IIIB-IIIB in FIG. 3(A).

FIG. 4(A) is a front view, FIG. 4(B) is a right side view, FIG. 4(C) is a top view and FIG. 4(D) is a bottom view.

FIG. 5(A) is a front view, FIG. 5(B) is a right side view, FIG. 5(C) is a top view and FIG. 5(D) is a bottom view.

FIG. 5 is to be attached, and FIG. 6(A) is a view viewed from the front and FIG. 6(B) is a view viewed from the rear.

FIG. 8(A) is a view viewed from the front and FIG. 8(B) is a view viewed from the right side.

FIG. 9(A) is a view viewed from the front and FIG. 9(B) is a cross-sectional view at a line IXB-IXB in FIG. 9(A).

FIG. 14(A) is a front view, FIG. 14(B) is a cross-sectional view at a line XIVB-IXVB in FIG. 14(A) and FIG. 14(C) is a perspective view.

FIG. 16(A) is a view viewed from the front and FIG. 16(B) is a cross-sectional view at a line XVIB-XVIB in FIG. 16(A).

DETAILED DESCRIPTION OF NON-LIMITING EXAMPLE EMBODIMENTS

Figure 1:
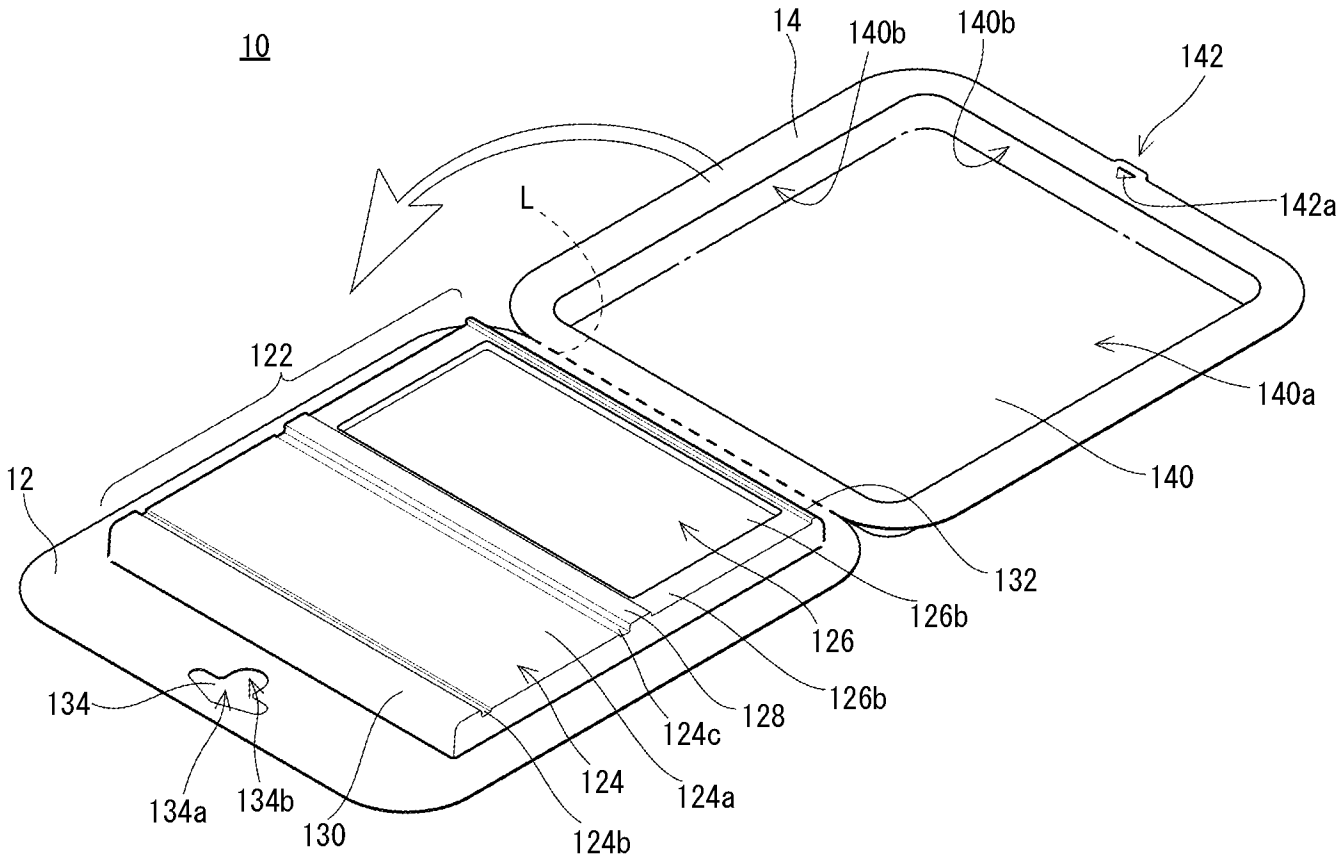
FIG. 1 is a perspective view obliquely viewing down a state that a non-limiting example packing container is opened.
Figure 2:
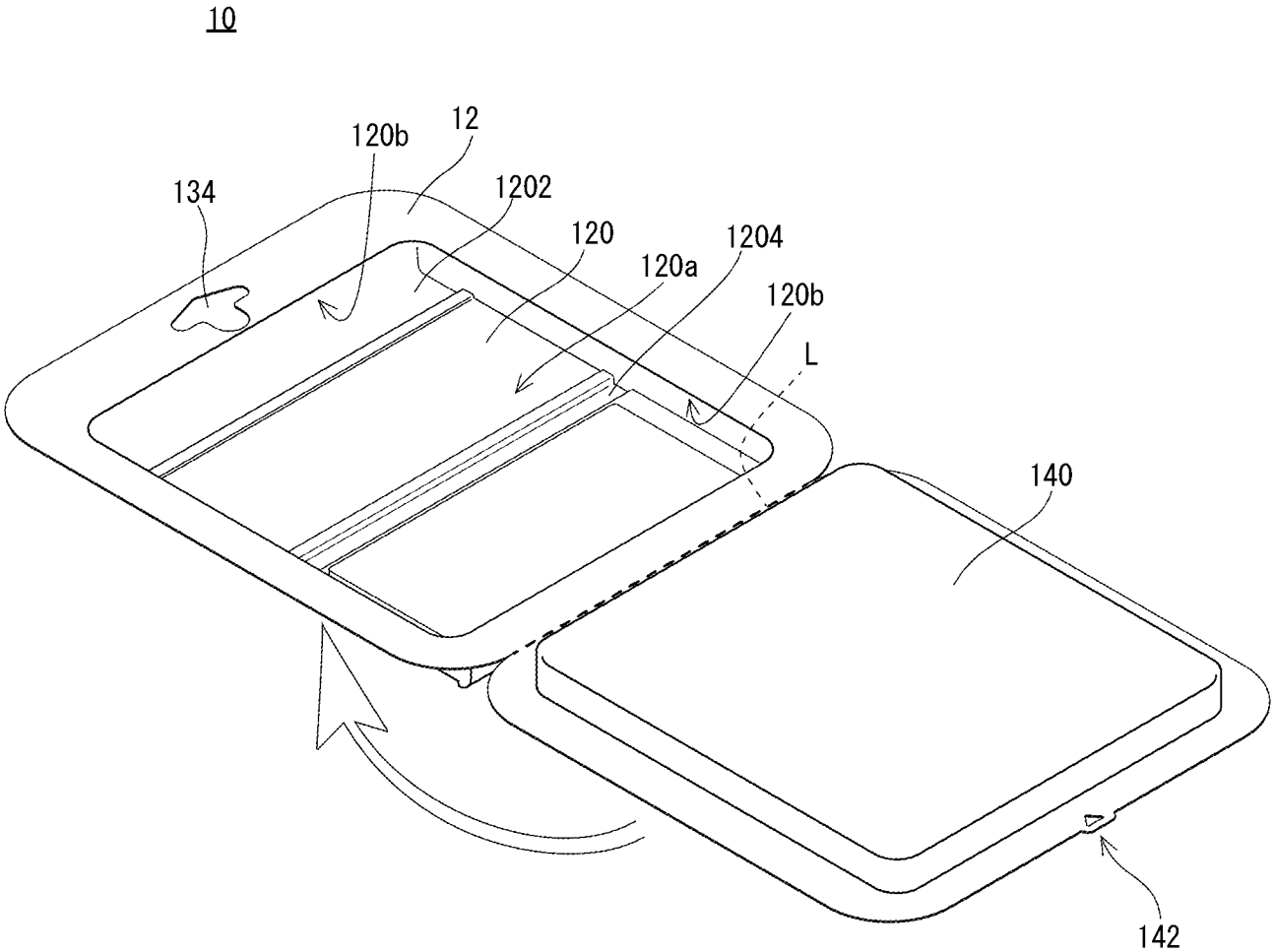
FIG. 2 is a perspective view obliquely viewing down the state that the non-limiting example packing container is opened while turning upside down.

With referring to FIG. 1 and FIG. 2, a non-limiting example packing container 10 includes a first member 12 and a second member 14, and the first member 12 and the second member 14 are integrally formed while being coupled to each other at a position of a polygonal line L. However, the first member 12 and the second member 14 may be individually formed.

In addition, FIG. 2 is a view turning the packing container upside down in an opened state shown in FIG. 1.

The first member 12 and the second member 14 are formed by a transparent synthetic resin, and stores two contents 22 and 24 (see FIG. 4 and FIG. 5) or the like in a state that the second member 14 is fit (closed) to the first member 12 so as to cover the first member. Furthermore, the first member 12 and the second member 14 are respectively formed with concave portions 120 and 140 at the rear side, and thus, protruded toward the front.

In addition, since the first member 12 and the second member 14 are formed by the transparent resin, lines appearing the back are seen in fact, but such lines appearing the back are omitted in FIG. 1 and FIG. 2.

As shown in FIG. 1 and FIG. 2, if the packing container 10 is folded and closed at the polygonal line L such that at least a part (a protruded part) of the first member 12 is covered by the concave portion 140 of the second member 14, as shown in FIG. 3(A) and FIG. 3(B), the protruded part of the first member 12 (a placing portion 122) is fit into the concave portion 140 of the second member 14. It should be noted that FIG. 3(A) is a view viewing a state that the packing container 10 is closed from the front and FIG. 3(B) is a cross-sectional view at a line IIIB-IIIB in FIG. 3(A).

In this specification, a direction in parallel to the polygonal line L in a case where the packing container 10 is viewed from the front as shown in FIG. 3(A) is called as a horizontal direction, and a direction perpendicular to this direction is called as a vertical direction. Furthermore, in a case where the packing container 10 is viewed from the front, one of sides in the horizontal direction is called as a leftward direction or a rightward direction. Furthermore, in a case where the packing container 10 is viewed from the front, one of sides in the vertical direction is called as an upward direction or a downward direction.

Therefore, since the first member 12 and the second member 14 are opened in FIG. 1 and FIG. 2, a direction perpendicularly going away from the polygonal line L is the upward direction of each of the first member 12 and the second member 14, and a direction perpendicularly leaving for the polygonal line L is the downward direction of each of the first member 12 and the second member 14.

Furthermore, a side that is protruded is called as the front (front side) in a state that the packing container 10 is closed as shown in FIG. 3(B), and a side that the concave portions 120 and 140 are provided is called as the rear (rear side).

Since the first member 12 and the second member 14 are opened in FIG. 1 and FIG. 2, the front side and the rear side are reversed with respect to the first member 12 and the second member 14.

Figure 14:
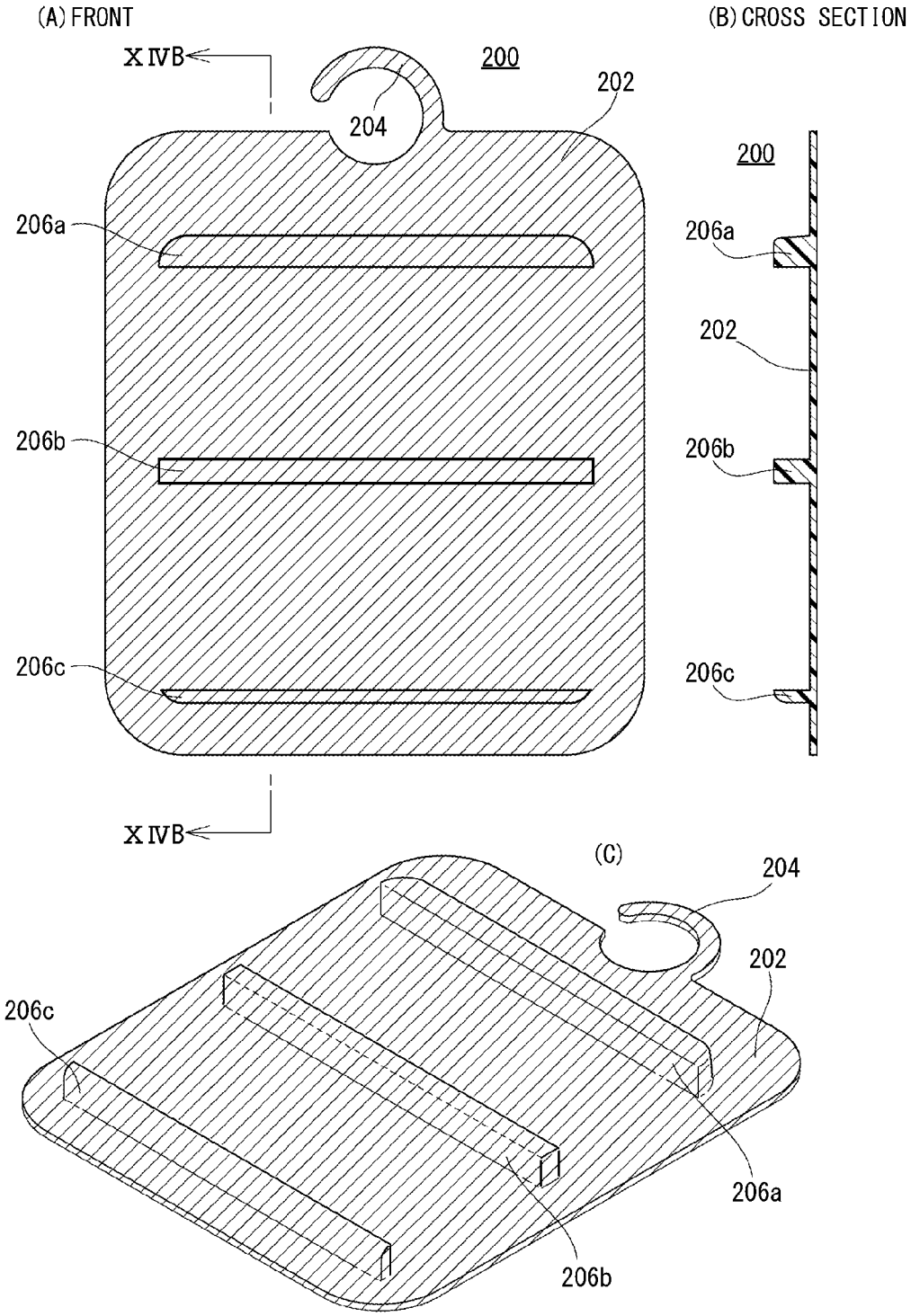
FIG. 14 shows a non-limiting example imitation which imitates a part of the game device shown in FIG. 6.

As shown in FIG. 2, the concave portion 120 of the first member 12 includes portions that a depth (height) is different from each other, and has a bottom 120*a* of an approximately rectangular shape. That is, the concave portion 120 has the bottom 120*a* having unevenness and four sides 120*b* each constituted by a plane, and respective joining portions of the bottom 120*a* and the four sides 120*b* are made as curved surfaces. There are provided with grooves 1202 and 1204 which respectively receive projections 206*a* and 206*b* of the imitation 200 (described later) on the bottom 120*a* (see FIG. 14 to FIG. 16).

Furthermore, as shown in FIG. 1, the concave portion 140 of the second member 14 has a constant depth (height) approximately equal to a maximum depth of the concave portion 120 of the first member 12. Therefore, the concave portion 140 has a bottom 140*a* constituted by a plane and four sides 140*b* each constituted by a plane, and respective joining portions of the bottom 140*a* and the four sides 140*b* are made as curved surfaces.

As described above, the concave portion 120 is provided on the first member 12 at the rear side and thus the front side thereof is protruded, thereby to form the placing portion 122 for placing the contents 22 and 24 (see FIG. 4 and FIG. 5) as shown in FIG. 1.

The placing portion 122 has two placing areas 124 and 126. The placing area 124 has a plane pedestal 124*a* on which the content 22 is placed and grooves 124*b* and 124*c* which receive parts of the content 22. The groove 124*b* is formed in an upper end portion of the placing area 124 to be extended in the horizontal direction. The groove 124*c* is formed in a lower end portion of the placing area 124 to be extended in the horizontal direction. The placing area 126*b* has a plane pedestal 126*a* on which the content 24 is placed and a concave portion 126*b* having a plane which is concaved toward the rear inside the pedestal 126*a*. In addition, a plane of the pedestal 124*a* and a plane of the pedestal 126*a* are flush or approximately flush with each other.

The placing portion 122 is provided with protrusions (projection strips) 128, 130 and 132. The protrusion 128 is provided between the placing area 124 and the placing area 126. In addition, in this embodiment, the protrusion 128 has a width approximately equal to a width in the vertical direction of a hinge 106 of a game device 100 described later. The protrusion 130 is provided in an upper side of the placing area 124. Furthermore, the protrusion 132 is provided a lower side of the placing area 126. The protrusion 130, the placing area 124, the protrusion 128, the placing area 126 and the protrusion 132 are arranged downwardly in this order.

In addition, in this embodiment, although the protrusion 128 is set with the width approximately equal to the width in the vertical direction of the hinge 106 of the game device 100, not limited to this. As described later, since the imitation 200 of the game device 100 is installed in the concave portion 120 of the packing container 10, the width of the protrusion 128 is appropriately changed according to a design of the imitation 200. Accordingly, the width in the vertical direction of the protrusion 128 is set to be the same as the width in the vertical direction of the hinge 106 of the game device 100, or set to be narrower than the width in the vertical direction of the hinge 106, or set to be wider than the width in the vertical direction of the hinge 106.

Front surface (surface upward in FIG. 1) of the protrusions 128, 130 and 132 are flush or approximately flush with each other, and protruded forward from the plane surface of the pedestal 124*a* and the pedestal 126*a*. Furthermore, as shown in FIGS. 3(A) and 3(B), if the first member 12 and the second member 14 are folded, the front surface of the protrusions 128, 130 and 132 come into contact with or close to the bottom 140*a* of the concave portion 140. In addition, in the placing area 124 and the placing area 126, a storing portion (space) is formed between the pedestals 124*a* and 126*a* and the bottom 140*a*.

Furthermore, as shown in FIG. 1 and FIG. 2, a hole 134 is formed at the center of an upper end portion of the first member 12. The hole 134 is constituted by a oblong hook hole 134*a* and a cut-out hole 134*b* which is formed by cutting out the hook hole 134*a*. That is, the cut-out hole 134*b* is formed on a periphery of a part of the hook hole 134*a*.

Furthermore, as shown in FIG. 1 and FIG. 2, a tab 142 for opening the packing container 10 is provided at the center of an upper end portion of the second member 14 and at a position opposite to the cut-out hole 134*b* provided on the first member 12 when the first member 12 is put on the second member 14. That is, as shown in FIG. 3(A), the first member 12 and the second member 14 are provided with portions that do not overlap with each other on in the periphery of the hook hole 134*a* when the packing container 10 is closed.

In addition, the tab 142 includes a portion that a part of an upper edge of the second member 14 is protruded upward. More specifically, the tab 142 is a portion that a user holds the second member 14 on the second member 14 with his/her fingers or places his/her fingers on the second member 14, and the tab 142 has an area or range of a size and a shape approximately equal to a size and a shape of the above-described cut-out hole 134*b*. The tab 142 is also formed with a hole 142*a* that a part of the tab 142 is hollowed out. In this embodiment, the hole 142*a* has a shape of a triangle whose vertex angle is located at the bottom.

In addition, in this embodiment, although the cut-out hole 134*b* is formed by cutting-out a part of the hook hole 134*a* in the first member 12 and the tab 142 is provided at the position opposite to the cut-out hole 134*b* of the second member 14, not limited to this.

For example, the cut-out hole 134*b* may not be formed and a width in the vertical direction of the hook hole 134*a* may be widened or a protruded amount of a protruded portion of the tab 142 may be made larger. One of these may be adopted or both of these may be adopted.

Although the tab 142 is protruded upward in this embodiment, not limited to this, and the tab 142 has only to be protruded in a direction different from a cut-out direction of the cut-out hole 134*b*.

Figure 3:
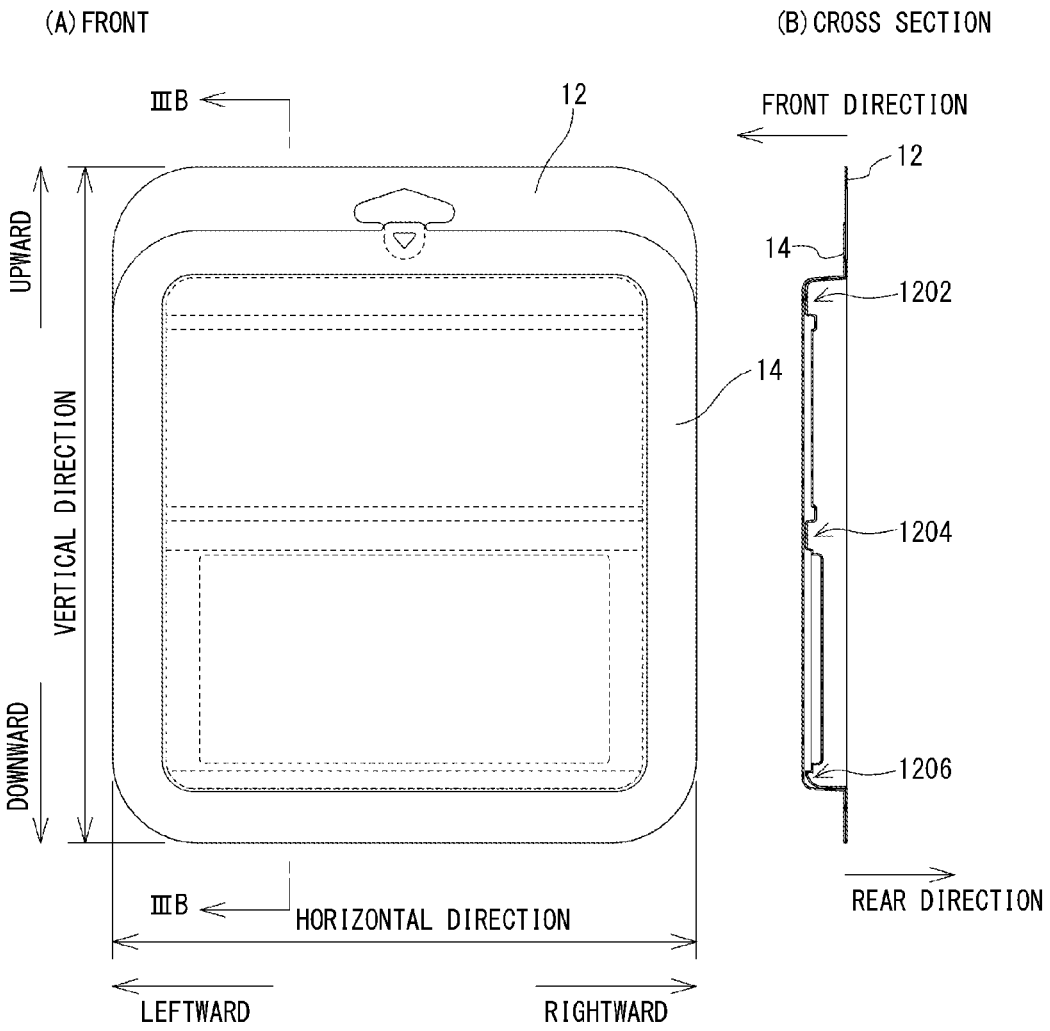
FIG. 3 shows a state that the non-limiting example packing container shown in FIG. 1
Figure 4:
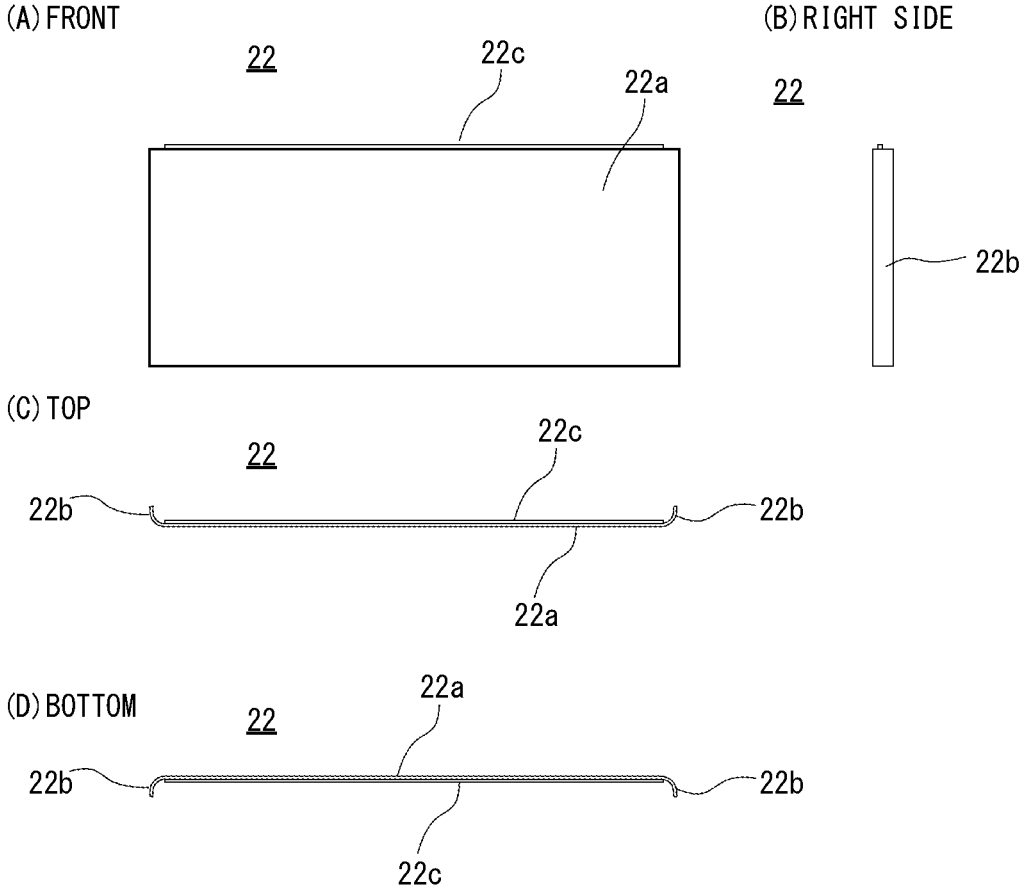
FIG. 4 shows a non-limiting example content to be stored in the packing container shown in FIG. 1 to FIG. 3.
Figure 5:
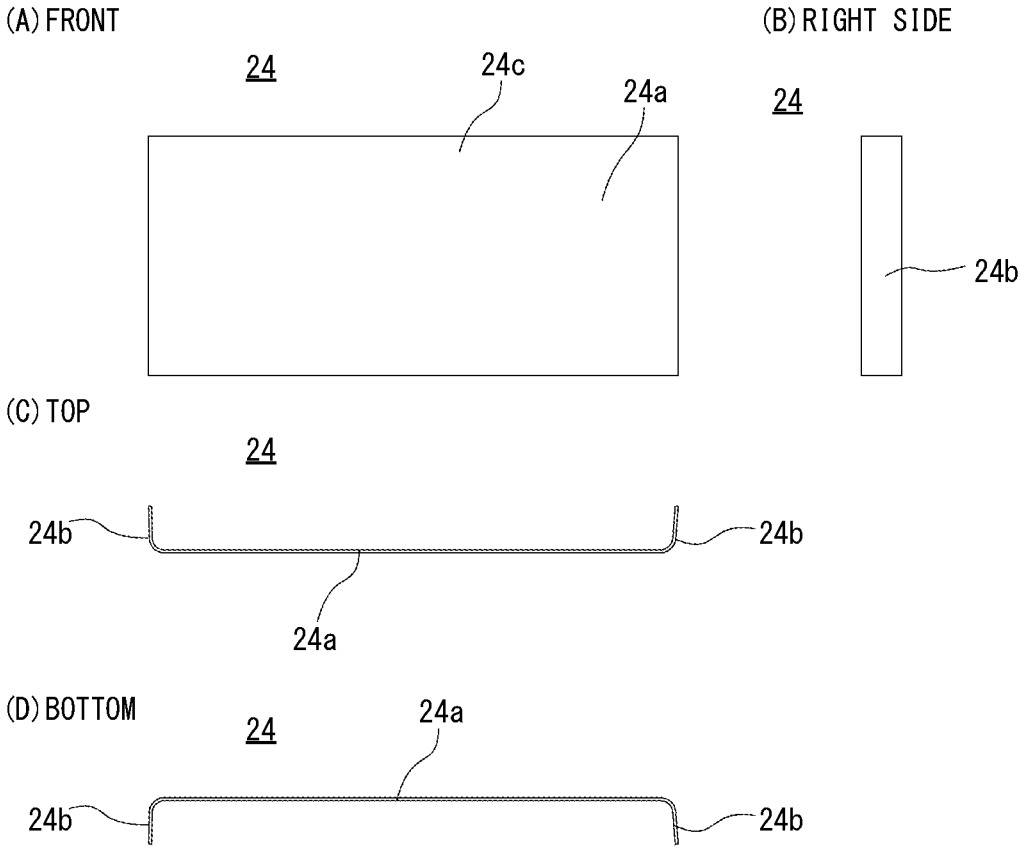
FIG. 5 shows another non-limiting example content to be stored in the packing container shown in FIG. 1 to FIG. 3.

FIG. 4 and FIG. 5 show examples of the contents 22 and 24 of the packing container 10 shown in FIG. 1 to FIG. 3. FIG. 4(A) is a front view of the content 22, FIG. 4(B) is a right side view of the content 22, FIG. 4(C) is a top view of the content 22 and FIG. 4(D) is a bottom view of the content 22. In addition, since a left side is simply symmetrical to a right side, a left side view is omitted here.

As shown in FIGS. 4(A), 4(B) and 4(D), the content 22 has a main body 22*a* which is formed by a oblong plane plate, and as shown in FIGS. 4(B), 4(C) and 4(D), the content 22 is provided, integrally with the main body 22*a*, with side plates 22*b* which are formed by bending both ends in the horizontal direction of the plane plate. Furthermore, as shown in FIGS. 4(A)-4(D), the content 22 is provided, integrally with the main body 22*a*, with an oblong projection 22*c* which is formed in one end in the vertical direction of the main body 22*a* to be extended in the vertical direction with a step corresponding to a thickness of the main body 22*a*.

Furthermore, FIG. 5(A) is a front view of the content 24, FIG. 5(B) is a right side view of the content 24, FIG. 5(C) is a top view of the content 24 and FIG. 5(D) is a bottom view of the content 24. In addition, since a left side is simply symmetrical to a right side, a left side view is omitted here.

As shown in FIGS. 5(A), 5(B) and 5(D), the content 24 has a main body 24*a* which is formed by a oblong plane plate, and as shown in FIGS. 5(B), 5(C) and 5(D), the content 24 is provided, integrally with the main body 24*a*, with side plates 24*b* which are formed by bending both ends in the horizontal direction of the plane plate.

In this embodiment, the plane plate of the content 22 and the plane plate of the content 24 are the same or approximately the same thickness that is approximately coincident with a protruded amount of the above-described protrusions 128, 130 and 132 from the pedestals 24*a* and 26*a*.

Figure 6:
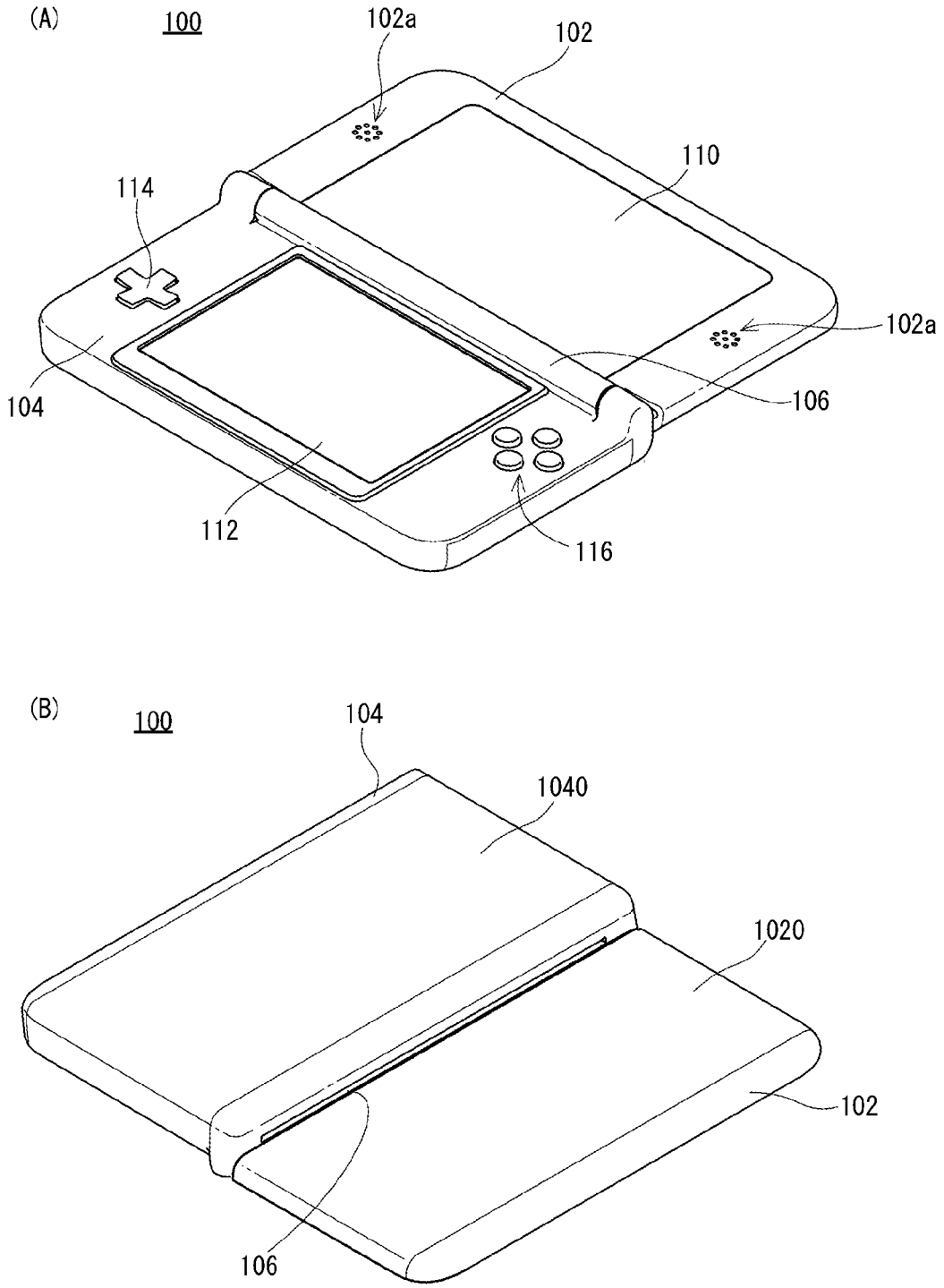
FIG. 6 shows a non-limiting example game device to which the contents shown in FIG. 4

In this embodiment, the content 22 and the content 24 are covers which constitute parts of housings (main body) of the game device 100 having an appearance as shown in FIGS. 6(A) and 6(B). The game device 100 is constructed to be openable/closable. FIG. 6(A) is a perspective view obliquely viewing down the front in a state that the game device 100 is opened and FIG. 6(B) is a perspective view obliquely viewing down the rear in the state that the game device 100 is opened.

As shown in FIG. 6(A), the game device 100 includes a first housing 102 and a second housing 104, and the first housing 102 and the second housing 104 are coupled to each other by a hinge 106 to be rotatable. Accordingly, the main body of the game device 100 is constituted by the first housing 102, the second housing 104 and the hinge 106.

As shown in FIG. 6(A), a first LCD 110 is provided on the front side of the first housing 102 at an approximately center, and the first housing 102 is provided at left and right with holes 102*a* for emitting a sound from speakers provided inside the first housing 102.

As shown in FIG. 6(A), a second LCD 112 is provided on the front side of the second housing 104 at approximately the center, and the second housing 104 is provided with a cross key 114 on the left side of the second LCD 112 and four push buttons 116 at the right of the second LCD 112.

As shown in FIG. 6(B), a cover 1020 being attachable/detachable is attached on a part of the rear of the first housing 102, and a cover 1040 being attachable/detachable is attached on a part of the rear of the second housing 104. The cover 1020 and the cover 1040 may be adhered by a double-face tape, or screwed by forming a screw hole. Instead of the cover 1020, the content 22 can be attached, and the content 24 may be attached instead of the cover 1040.

In addition, the configuration of the game device 100 shown in FIG. 6(A) and FIG. 6(B) is an example, and not limited to this. For example, a touch panel may be provided instead of the second LCD 112 or on the second LCD 112.

For example, the content 22 and the content 24 are added with predetermined colors, applied (drawn) with predetermined patterns and/or predetermined characters (animation character, game character, etc.). In addition, the colors added to the content 22 and the content 24 may be the same or different from each other. Different kinds of characters may be drawn on the content 22 and the content 24, or a large character may be represented or a large pattern or picture may be represented by combining the characters or pictures drawn on the contents 22 and 24.

In addition, in an ordinary game device 100, a predetermined color(s) is added to a main body, i.e., the housings 102 and 104 and the hinge 106. Accordingly, as described above, by exchanging the cover 1020 and the cover 1040 with the content 22 and the content 24, a color or pattern of the parts of the first housing 102 and the second housing 104 can be changed, or a desired character can be applied to at least one of the first housing 102 and the second housing 104. That is, it is possible to perform an exchange of cover ("Kisekae" in Japanese language) for parts of the first housing 102 and the second housing 104; however, the cover 1020 and the cover 1040 may be simply replaced with the content 22 and the content 24 each having the same color with the color of each of the cover 1020 and the cover 1040.

Figure 7:
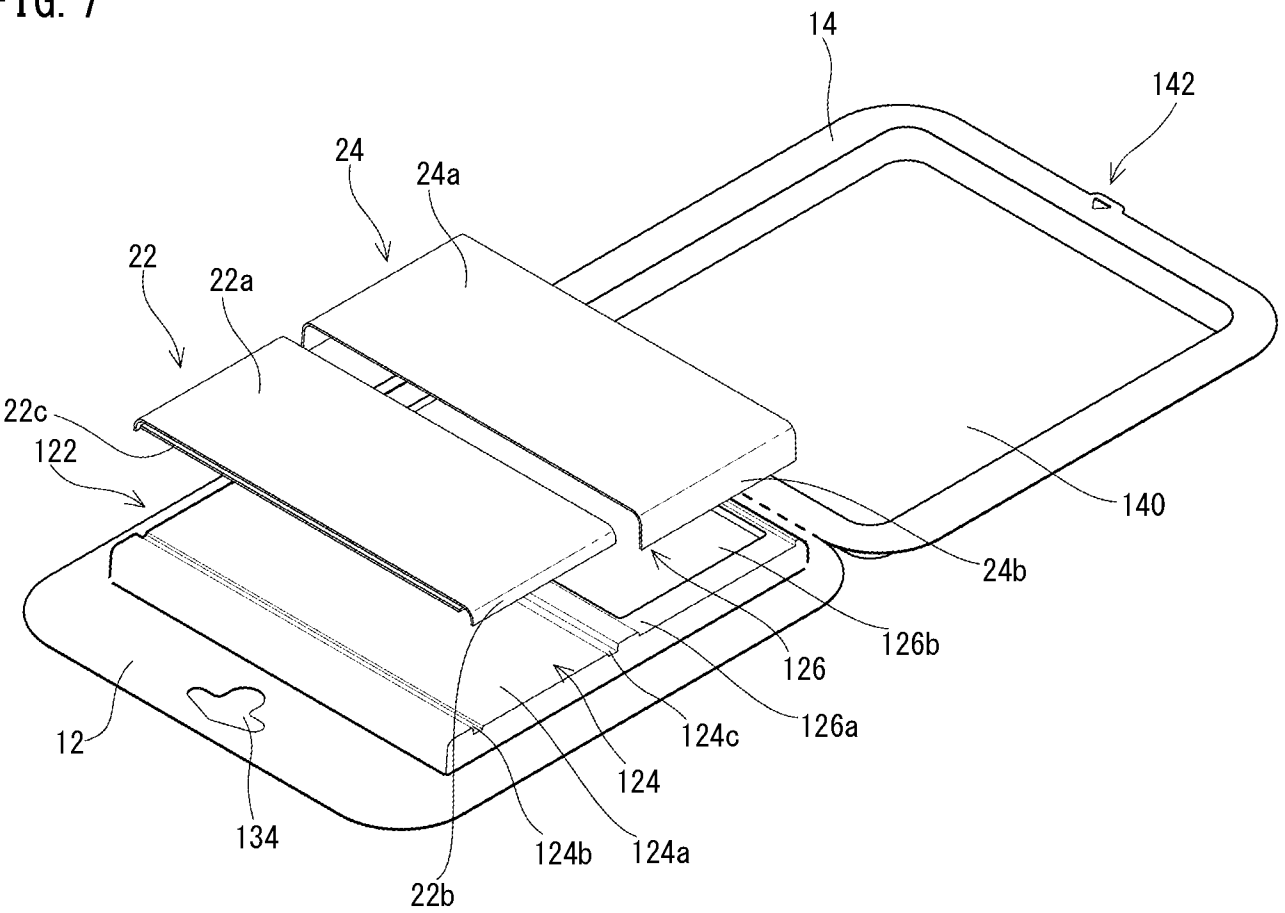
FIG. 7 is a view showing a non-limiting example state that in the way of placing the contents shown in FIG. 4 and FIG. 5 on the packing container in an opened state.
Figure 8:
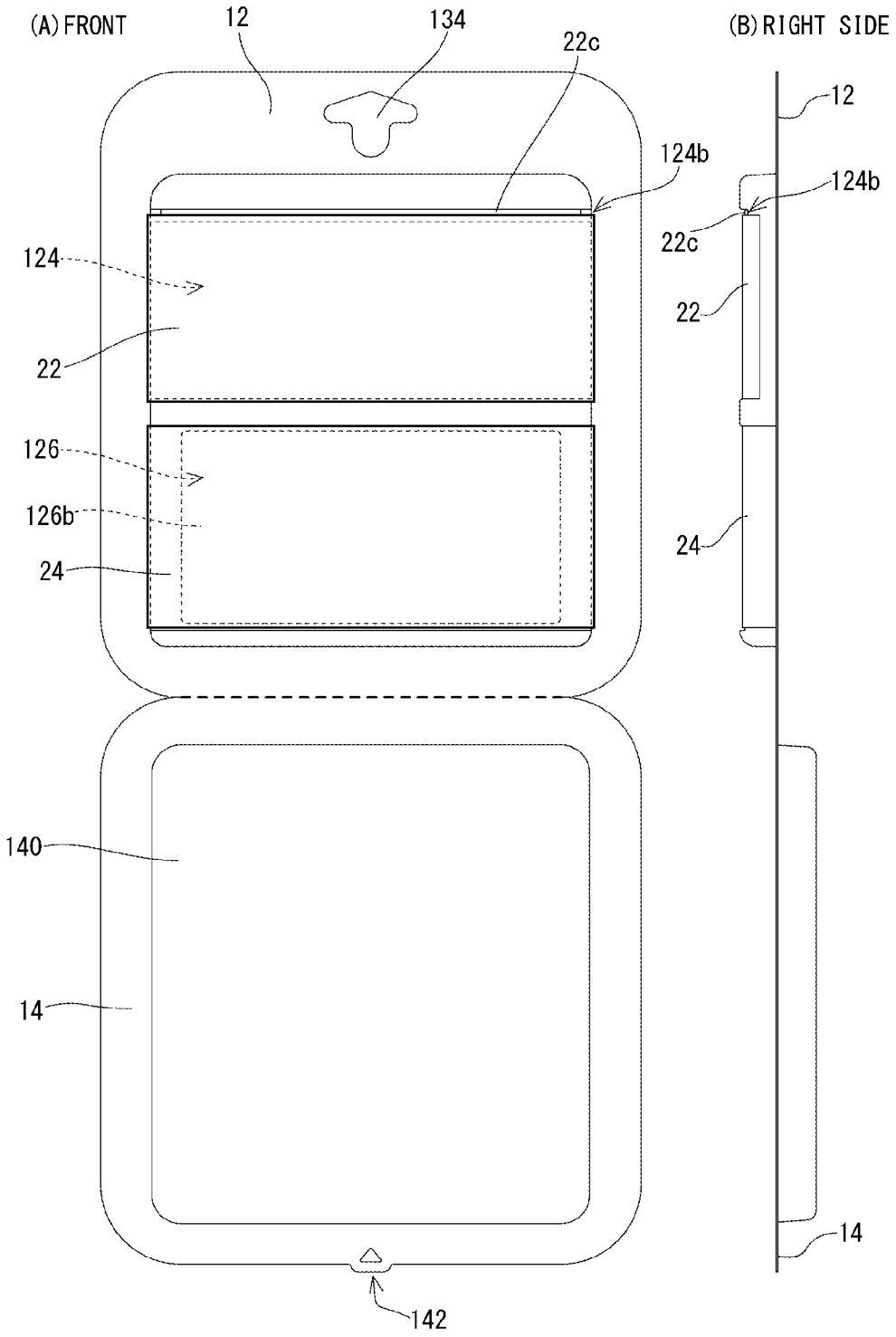
FIG. 8 shows a non-limiting example state that the contents shown in FIG. 4 and FIG. 5 are placed on the packing container in an opened state.

The content 22 corresponding to the cover 1020 and the content 24 corresponding to the cover 1040 are stored in the packing container 10. As shown in FIG. 7, FIG. 8(A) and FIG. 8(B), the content 22 is placed on the pedestal 124*a* in the placing area 124 and the content 24 is placed on the pedestal 126*a* in the placing area 126.

FIG. 7 is a perspective view showing a way of placing the content 22 and the content 24 on the placing portion 122 of the packing container 10. FIG. 8(A) is a view viewed from the front where the content 22 and the content 24 are placed on the placing portion 122 of the packing container 10 and FIG. 8(B) is a right side view of FIG. 8(A).

As shown in FIG. 8(A) and FIG. 8(B), the projection 22*c* that is provided on the content 22 is received by the groove 124*b* that is formed in the placing area 124. Therefore, it is possible to make the lower (inside) of the content 22 come into contact with the pedestal 124*a* of the placing area 124. Furthermore, it is possible to make the lower (inside) of the content 24 come into contact with the pedestal 126*a* of the placing area 126.

In addition, a storing portion (space) different from the storing portion that the content 24 is stored is formed on the rear side of the content 24 by the concave portion 126, and in this storing portion, a user's manual for the content 22 and the content 24 or the like is stored.

The content 22 can be placed in the placing area 124 while the projection 22*c* is directed downward. In such a case, the projection 22*c* is received by the groove 124*c*. A reason why the content 22 can be placed in either direction upward or downward is for making a direction of the character printed on the surfaces of the contents 22 and 24 able to be set to a direction that a supplier or seller of the contents 22 and 24 desires in displaying the packing container 10 that the contents 22 and 24 are stored.

Then, by folding at the polygonal line L such that the second member 14 covers a part of the first member 12, the placing portion 122 that the content 22 and the content 24 are placed is fit into the concave portion 140 provided on the second member 14 as shown in FIG. 9(A) and FIG. 9(B) being a cross-sectional view at a line IXB-IXB. Accordingly, the bottom 140*a* of the concave portion 140 is brought into contact with or close to the front surfaces of the content 22 and the of the content 24, whereby the content 22 and the content 24 can be stored (sealed) in the packing container 10.

In addition, the packing container 10 that stores the content 22 and the content 24, i.e. the covers can be called as a package (cover package).

Furthermore, a mechanism which locks an overlapping state of the first member 12 and the second member 14 may be provided or abutting portion of the first member 12 and the second member 14 may be welded or adhered.

Figure 10:
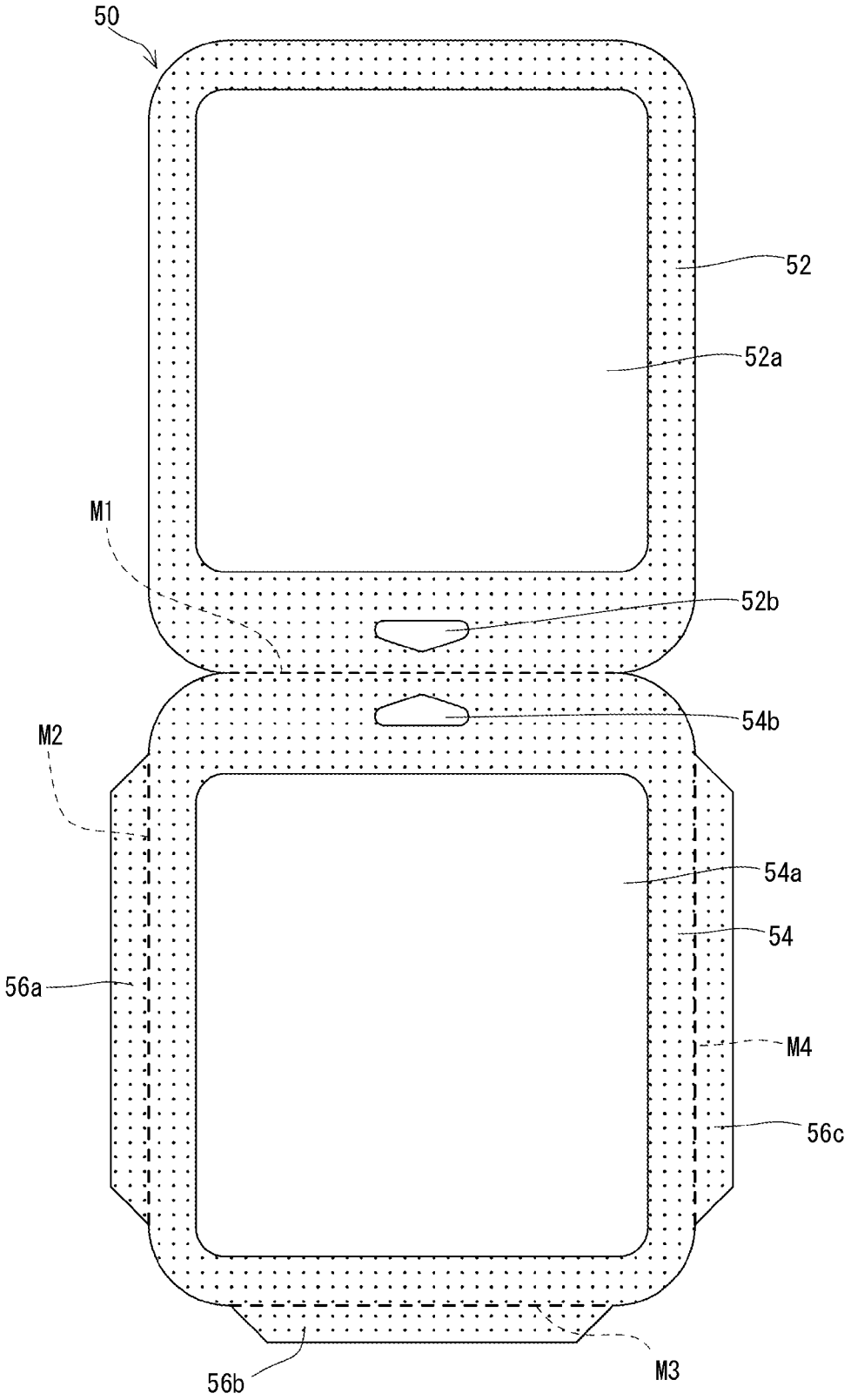
FIG. 10 is a view showing a non-limiting example mount to which the packing container storing the contents is pasted.

Furthermore, the packing container 10 that the content 22 and the content 24 are stored in is pasted onto a mount 50 as shown in FIG. 10. This is for preventing a state that the second member 14 covers the first member 12 from easily released and/or for displaying a trade name or brand name of the content 22 and the content 24.

In addition, the packing container 10 storing the covers and pasted to the mount 50 (covered by the mount 50), that is, a packing container with mount 60 described later may be called a package.

As shown in FIG. 10, the mount 50 includes a front cover 52 and a back cover 54 each using an opaque paper (cardboard), and the front cover 52 and the back cover 54 are coupled to each other at a position of a polygonal line M1 to be integrally formed. In addition, in FIG. 10 (also in FIG. 11 to FIG. 13, FIG. 15 and FIG. 16), it is indicated that the mount 50 is opaque by using dots.

Furthermore, the front cover 52 and the back cover 54 have the same or similar shape, and are formed approximately symmetrically around the polygonal line M1; however, three (3) areas 56*a*, 56*b* and 56*c* for pasting the packing container 10 that the content 22 and the content 24 are stored to the mount 50 by the double-face tape or paste are coupled to the back cover 54 at positions of polygonal lines M2, M3 and M4.

There is formed, at the center of the front cover 52, with an aperture 52*a* having a shape that is the same as the bottom 140*a* of the concave portion 140 of the second member 14 and is slightly larger than the bottom 140*a*. Furthermore, there is formed, between the aperture 52*a* and the polygonal line M1, with an aperture 52*b* having approximately the same shape and the same size as those of the hook hole 134*a*. Similarly, an aperture 54*a* and an aperture 54*b* are formed on the back cover 54. The aperture 54*a* is formed with a position and a size that the aperture 54*a* overlaps with the aperture 52*a* when the front cover 52 and the back cover 54 are folded at the polygonal line M1. The aperture 54*b* is formed with a position and a size that the aperture 54*b* overlaps on the aperture 52*b* when the front cover 52 and the back cover 54 are folded at the polygonal line M1.

The aperture 52*a* and the aperture 54*a* are provided for showing the content 22 and the content 24 that are stored in the packing container 10 and for showing the imitation 200 (see FIG. 14) that is installed in the packing container 10 through the packing container 10.

Furthermore, the aperture 52*b* and the aperture 54*b* are provided not to close the hook hole 134*a*; however, the cut-out hole 134*b* and the tab 142, that is, the portion that the first member 12 and the second member 14 do not overlap with each other in the periphery of the hook hole 134*a* is covered by the mount 50. Accordingly, the packing container 10 that is pasted to the mount 50 is prevented from unintentionally being opened during a time that the same is transported or conveyed or displayed.

Figure 11:
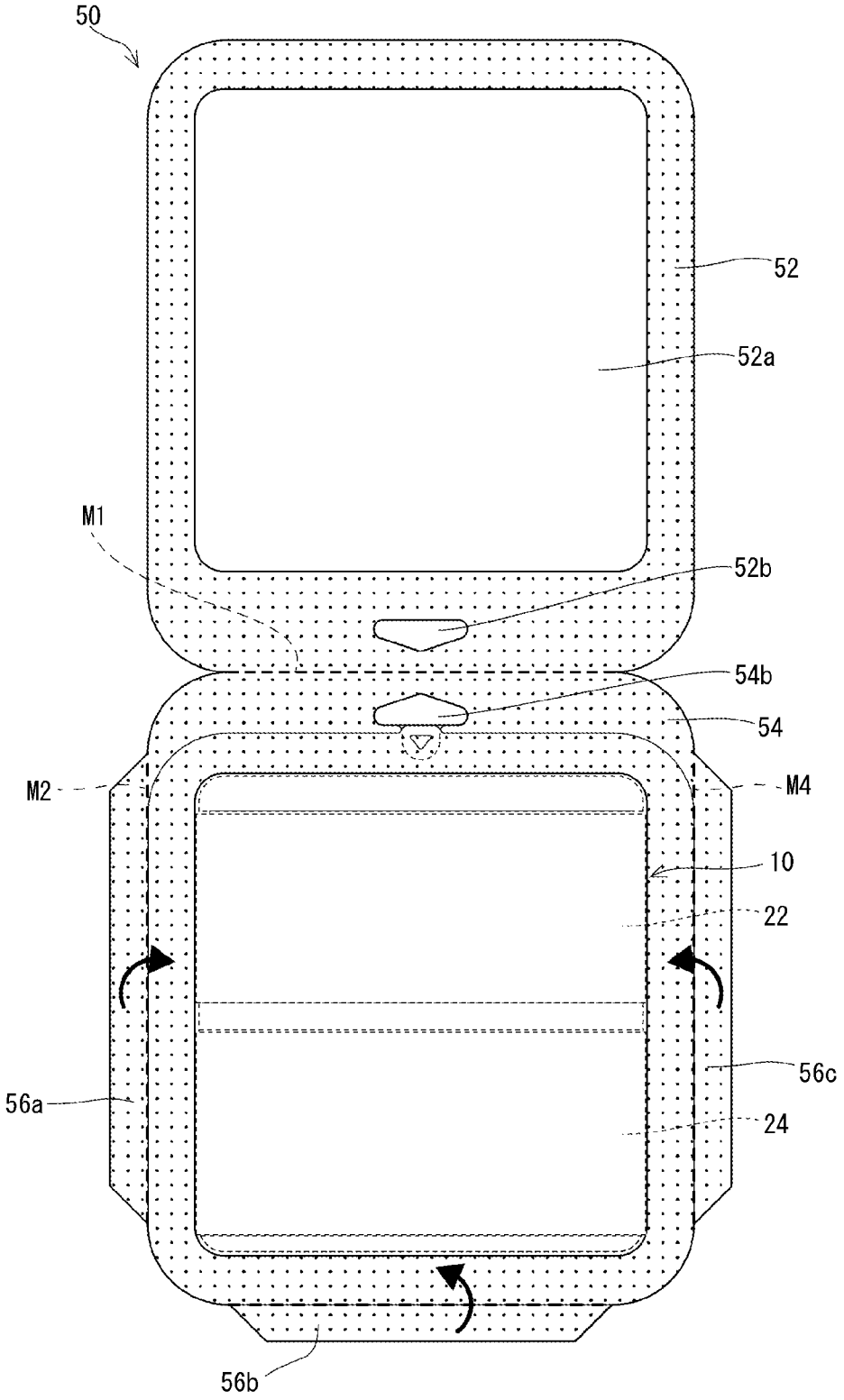
FIG. 11 is a view showing a non-limiting example method of pasting the packing container storing the contents to the mount.
Figure 12:
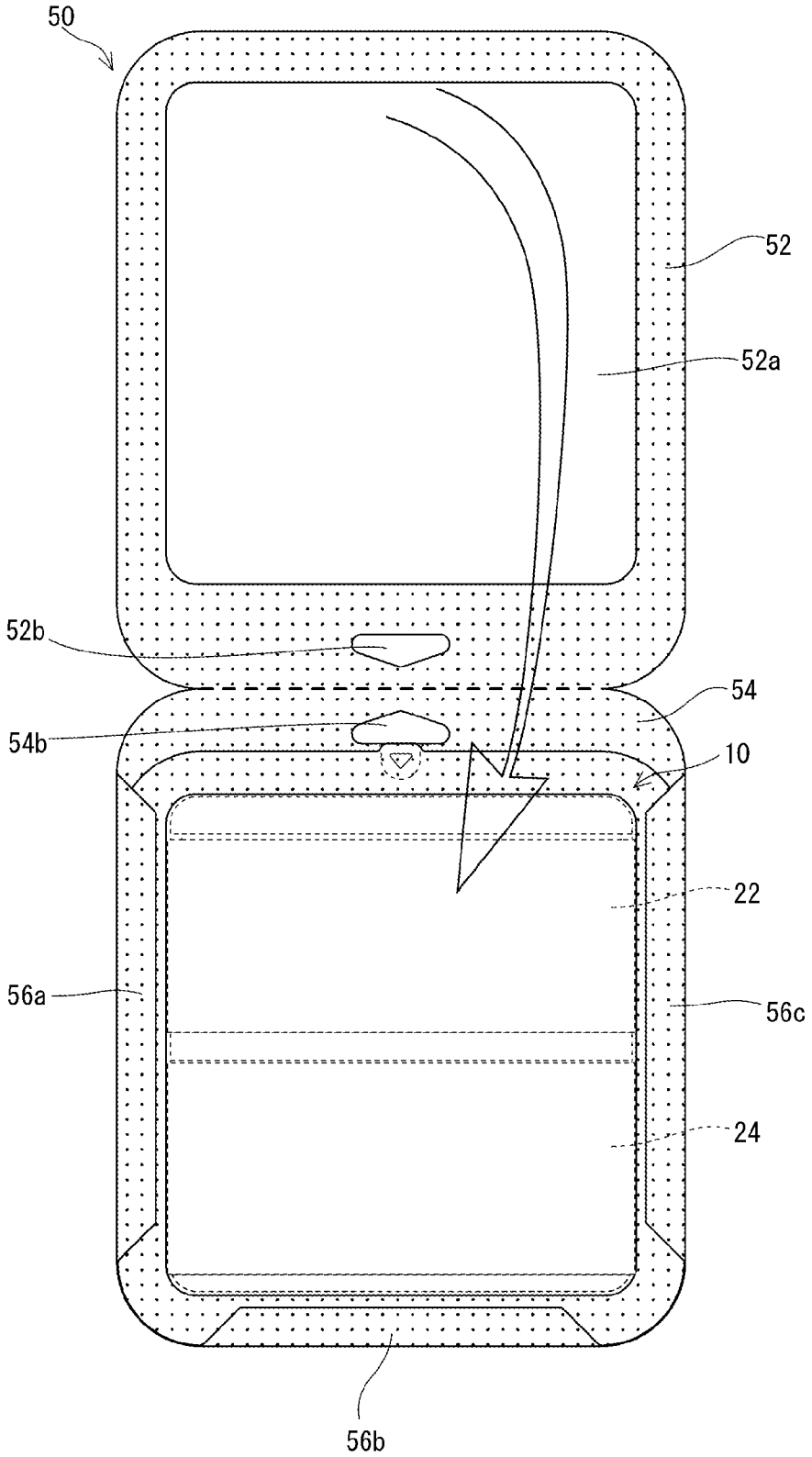
FIG. 12 is a view showing another non-limiting example method of pasting the packing container storing the contents to the mount.
Figure 13:
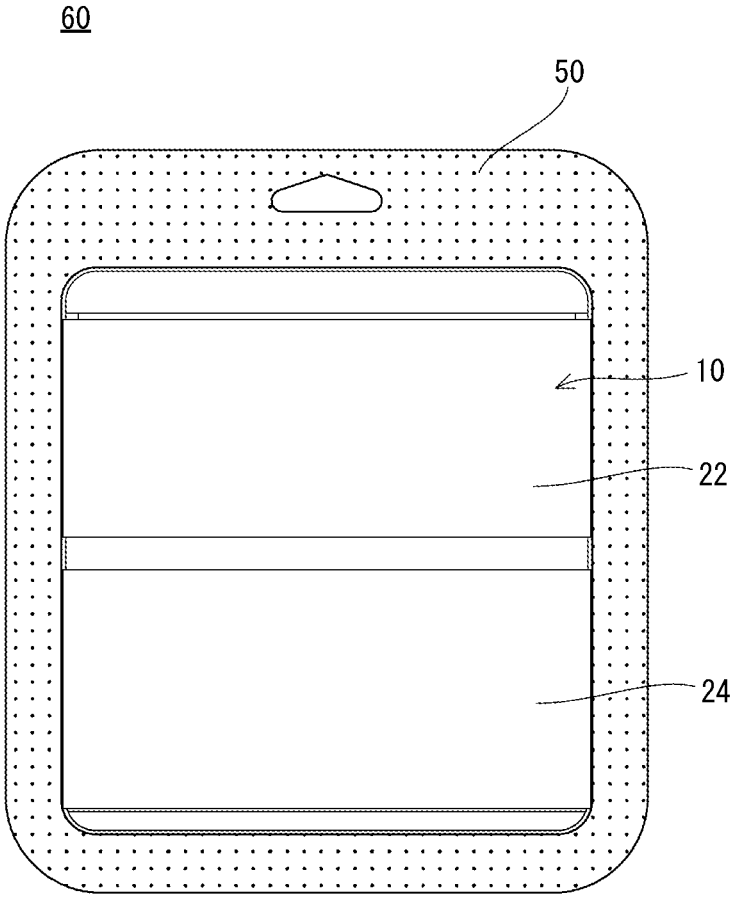
FIG. 13 is a view showing a non-limiting example packing container with mount, viewed from the front.

As shown in FIG. 11, the packing container 10 that stores the content 22 and the content 24 is placed on the back cover 54, and as shown in FIG. 12, each of the areas 56*a*, 56*b* and 56*c* is folded back at each of the polygonal lines M2, M3 and M4 to be pasted to the portion of the second member 14 of the packing container 10 that the concave portion 140 is not formed. The front cover 52 is folded back at the polygonal line M1 to be pasted to the areas 56*a*, 56*b* and 56*c* as shown by an arrow mark in FIG. 12. Accordingly, as shown in FIG. 13, the packing container 10 that stores the content 22 and the content 24 is pasted to (wrapped by) the mount 50. Hereinafter, the packing container 10 in such a state is called as "packing container with mount 60".

In addition, in FIG. 13 (also in FIG. 15 and FIG. 16), in order to illustrate the packing container with mount 60 to be easily understood, the lines of the first member 12 being seen in the back of the contents 22 and 24 that is stored in the packing container 10 and the second member 14 are also illustrated by solid lines.

In the packing container with mount 60, the packing container 10 itself is transparent and the protrusions 128, 130 and 132 are not covered by the content 22, the content 24 and the mount 50. Therefore, in a case where the packing container with mount 60 is viewed from the front (in the front view), it is possible to see the back of the packing container with mount 60 through the protrusions 128, 130 and 132. Similarly, since the side 120*b* of the concave portion 120 of the first member 12 and the side 140*b* of the concave portion 140 of the second member 14 are not covered at all, when the packing container with mount 60 is seen from the side (in the side view), an opposite side of the packing container with mount 60 can be seen through the side 120*b* and the side 140*b*.

As such the packing container with mount 60 is displayed in a manner that the same is hung on the hook provided on the store fixture or display shelf in the shop, or other manner. In a case where the user considers replacement (change) of the covers 1020 and 1040 of the game device 100, usually, it is necessary to fit the content 22 and the content 24 to the game device 100 by taking out the content 22 and the content 24 from the packing container with mount 60.

However, before purchase, usually, it is impossible to take out the content 22 and the content 24 from the packing container with mount 60 to fit the content 22 and the content 24 to the game device 100 that the user owns. Therefore, it is possible to easily consider that a sample that the cover 1020 and the cover 1040 are replaced with the content 22 and the content 24 for each color of the game device 100 is prepared; however, because the colors of the game device 100 (colors of the housings 102 and 104 and the hinge 106) are in a plural number of kinds and the content 22 and the content 24 are also in a plural number of kinds, it is difficult to prepare the above-described samples for all combinations.

Under the circumstances, in this embodiment, the imitation 200 that imitates a part of the game device 100 is prepared, and by installing the imitation 200 in the packing container with mount 60, it is allowed the user to easily know an appearance when the game device 100 is cover-changed. For example, the imitation 200 is colored 5 by the same color as the housings 102 and 104 and the hinge 106 of the game device 100, and prepared for each color of the game device 100.

The imitation 200 is formed by a synthetic resin, for example, and as shown in FIGS. 14(A), 14(B) and 14(C), includes a plane plate 202. In addition, FIG. 14(A) is a view viewing the imitation 200 from the front, FIG. 14(B) is a cross-sectional view at a line XIVB-XIVB in FIG. 14(A), and FIG. 14(C) is a perspective view obliquely viewing down the imitation 200.

Figure 15:
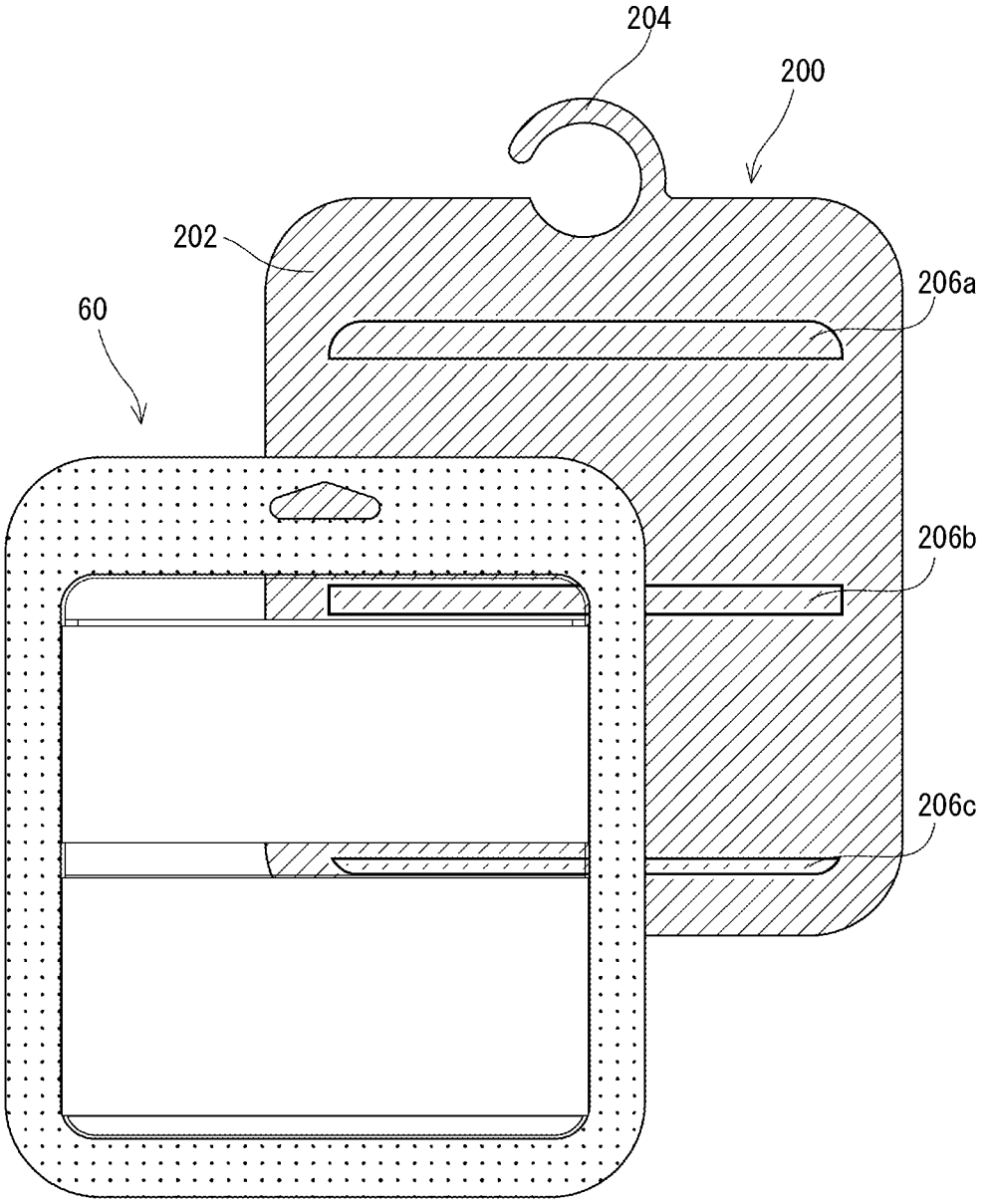
FIG. 15 is a view showing a non-limiting example state that in the way of installing the imitation shown in FIG. 14 in the packing container with mount shown in FIG. 13, viewed from the front.
Figure 16:
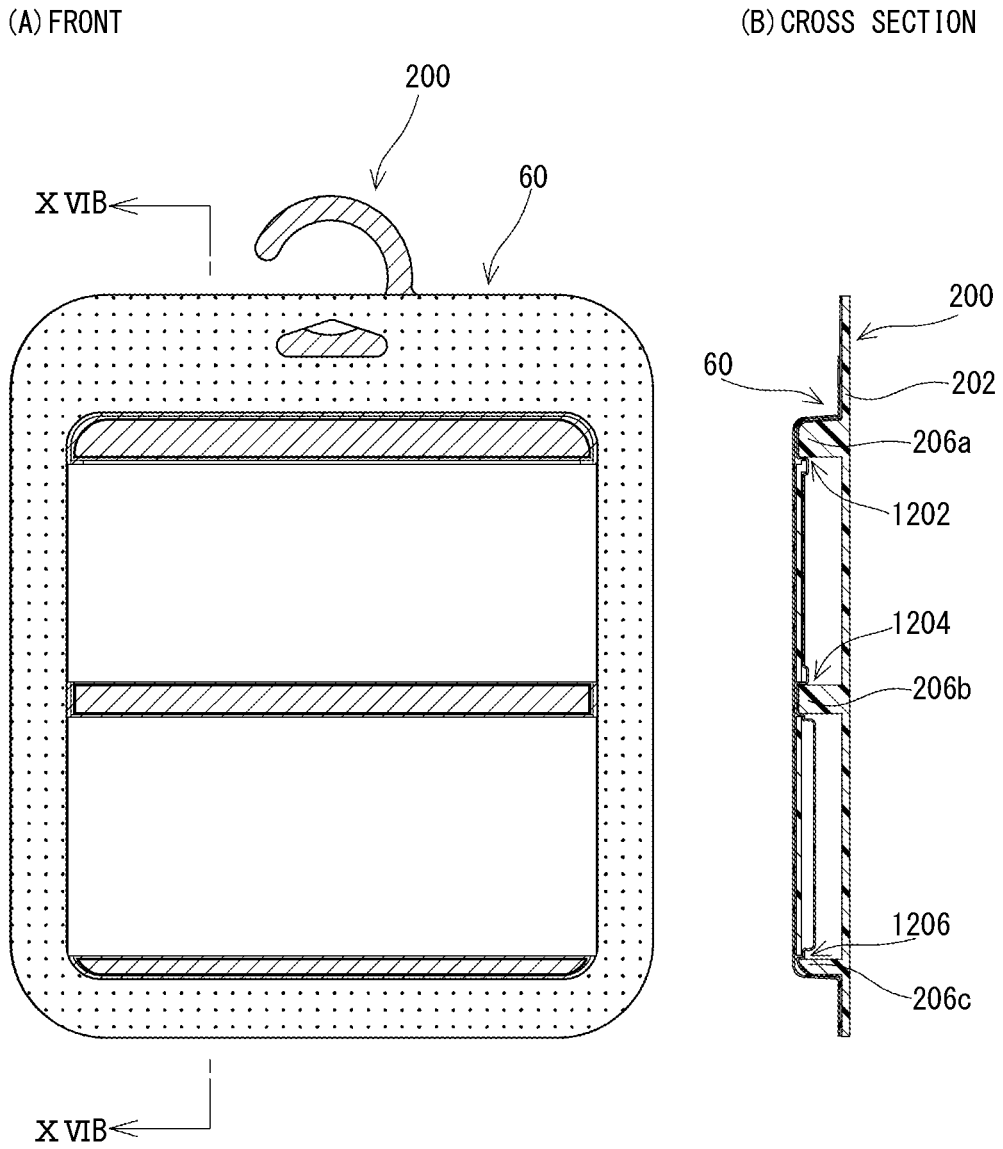
FIG. 16 shows a non-limiting example state that the imitation shown in FIG. 14 is installed in the packing container with mount shown in FIG. 13.

In addition, in FIG. 14(A) and FIG. 14(C) (also in FIG. 15, FIG. 16(A) and FIG. 16(B)), it is indicated by slant lines that a predetermined color is added to the imitation 200.

A hook 204 is formed in one end in the vertical direction of the plane plate 202. Furthermore, the imitation 200 includes a projection 206*a*, a projection 206*b* and a projection 206*c* each of which is formed on the front of the plane plate 202 and has a size (width and length) capable of being fallen (fit) into each of a groove 1202, a groove 1204 and a groove 1206 formed on the bottom 120*a* of the concave portion 120 on the first member 12.

The projection 206*a* corresponds to a portion (an upper end portion) except a portion that is covered by the cover 1020 out of the first housing 102 of the game device 100. The projection 206*b* corresponds to a portion of the hinge 106 that couples the first housing 102 and the second housing 104 of the game device 100 to each other. The projection 206*c* corresponds to a portion (a lower end portion) except a portion that is covered by the cover 1040 out of the second housing 104.

Since the first housing 102 and the second housing 104 are coupled to each other by the hinge 106 in the game device 100 as shown in FIGS. 6(A) and 6(B), the of the cover 1020 and the of the cover 1040 are not provided in the same plane; however, in the packing container with mount 60, the heights of the projections 206*a*, 206*b* and 206*c* are made the same because the content 22 and the content 24 are stored with flush or approximately flush.

For example, the user selects the imitation 200 having the same color as the color of the user's own game device 100, and as shown in FIG. 15, the selected imitation 200 is attached to the packing container with mount 60 from the rear side. Then, as shown in FIG. 16(A) and FIG. 16(B), the projections 206*a*, 206*b* and 206*c* are fit into the concave portion 120.

In addition, FIG. 16(A) is a view viewing from the front a state that the imitation 200 is attached to the packing container with mount 60, and FIG. 16(B) is a cross-sectional view at a line XVIB-XVIB in FIG. 16(A).

As understood well from FIG. 16(B), the projection 206*a* of the imitation 200 is fit into the groove 1202, the projection 206*b* of the imitation 200 is fit into the groove 1204, and the projection 206*c* of the imitation 200 is fit into the groove 1206.

Accordingly, the surfaces or fronts (protruded surfaces) of the projections 206*a*, 206*b* and 206*c* become approximately flush with the surfaces of the content 22 and the content 24. Accordingly, the user can easily know an appearance like a case where the content 22 and the content 24 are attached to the game device 100. More specifically, when the packing container with mount 60 that the imitation 200 is installed is viewed from the front, it is possible to know an appearance in a state that the game device 100 that is attached with the content 22 and the content 24 is opened and viewed from the rear. Furthermore, when the packing container with mount 60 that the imitation 200 is installed is viewed from the side, it is possible to know an appearance in the state that the game device 100 that is attached with the content 22 and the content 24 is opened and viewed from the side, and when the packing container with mount 60 that the imitation 200 is installed is viewed obliquely down, it is possible to know an appearance of the rear side in the state that the game device 100 that is attached with the content 22 and the content 24 is opened and viewed obliquely down.

Thus, the user can select (buy) a desired packing container with mount 60 by selecting the imitation 200 having the same color as the color of the game device 100 that the user himself/herself owns and by sequentially attaching the selected imitation 200 to each of the packing containers with mount 60 that stores different kinds of the contents 22 and the contents 24 while seeing an appearance in a case of the exchange of cover.

Figure 9:
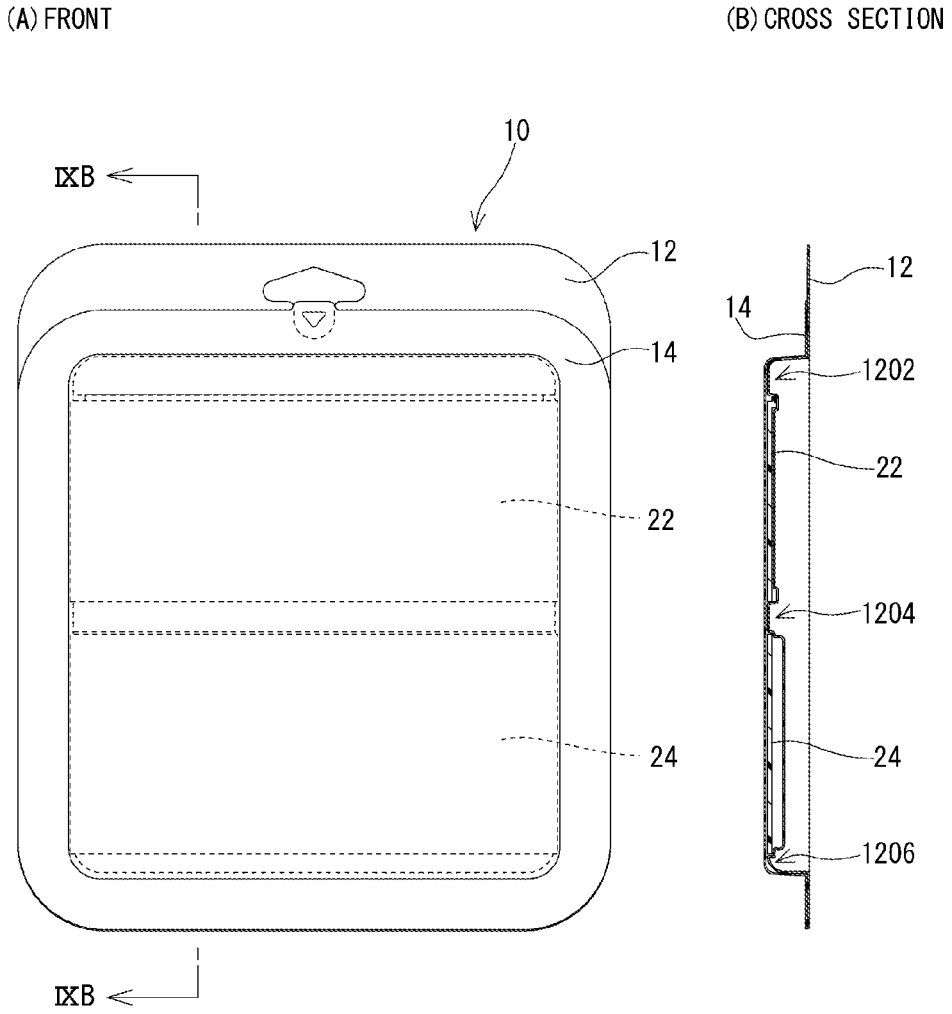
FIG. 9 shows a non-limiting example state that the contents shown in FIG. 4 and FIG. 5 are stored in the packing container.

Furthermore, the user takes out the content 22 and the content 24 of the packing container 10 after separating the mount 50 from the packing container 10 if the user buys the packing container with mount 60. In addition, the packing container 10 that the mount 50 is separated is as shown in FIG. 9. At this time, the user can render the first member 12 and the second member 14 in an opened state by holding with one hand a portion that is not overlapped with the first member 12 and the second member 14 while holding with the other hand the tab 142 provided on the second member 14 and by pulling the second member 14 in the direction indicated by the vertex angle of the hole 142*a*. That is, the user can release (open) the packing by the first member 12 and the second member 14.

Since the hole 134 is constituted by the hook hole 134*a* and the cut-out hole 134*b* and the cut-out hole 134*b* is provided at a position opposite to the tab 142 as shown in FIG. 1 to FIG. 3, the user can easily hold the tab 142. Furthermore, the user can intuitively know the direction that the tab 142 is to be pulled by the vertex angle of the triangle of the hole 142*a* formed on the tab 142. Accordingly, it is possible to easily release the packing.

According to this embodiment, by fitting the imitation that imitates a part of the game device to the packing container with mount having the transparent portion when viewed from the front, it is possible to see an appearance like a case where the contents are attached to the game device. That is, it is possible to easily know a desired combination.

Furthermore, according to this embodiment, since the portion that the first member and the second member do not overlap with each other in the periphery of the hook hole in the second member of the packing container, it is possible to easily open the packing container by holding the first member and the second member with different hands, respectively.

In addition, although the cover that constitutes a part of a housing of the electronic equipment such as a game device is stored in the packing container, the content is not limited to that of this embodiment.

For example, a cover which covers a part of the housing of the game device to protect the housing may be the content.

For example, a seal which covers a part of the game device to decollate the housing may be the content.

Furthermore, not for the game device, a cover which constitutes a part of a housing of a foldable cellular phone or covers a part of the housing thereof may be stored.

Furthermore, a cover for a housing of a toy that imitates a foldable game device or a cover that covers the housing or a cover that constitutes a part of a toy that imitates the foldable cellar phone or a cover that covers the housing may be stored in the packing container. In addition, such toys may or may not incorporate electronic equipment. That is, in this specification, a term "device" is utilized to cover such a toy having no electronic equipment.

Furthermore, other than the foldable game device and the foldable cellar phone and the toys that imitate the foldable game device or the foldable cellar phone, a cover that constitutes a part of a housing of a device with hinged double doors or a cover that protects the housing may be stored.

In addition, shapes and so on of the packing container and the mount shown in this embodiment are only examples and may be appropriately changed in accordance with actual products.

Although the two contents (covers) are stored in the packing container while being arranged in the vertical direction because the first housing and the second housing are opened in the vertical direction in the game device shown in the embodiment, in a case where covers for a device that a first housing and a second housing are opened in the horizontal direction as if a book is opened, two contents are arranged in the horizontal direction.

While certain example systems, methods, storage media, devices and apparatuses have been described herein, it is to be understood that the appended claims are not to be limited to the systems, methods, storage media, devices and apparatuses disclosed, but on the contrary, are intended to cover various modifications and equivalent arrangements included within the spirit and scope of the appended claims.

What is claimed is:

1. A packing container configured to pack a cover that one of (a) constitutes a part of a main body of a device or (b) covers the part of the main body, the packing container comprising:

a storing portion configured to store the cover; and an installing portion configured to install the packing container to an imitation that imitates at least a part of the device and that is external to the packing container, wherein at least a part of an area of the packing container other than an area storing the cover is transparent through the packing container so that when the cover is stored in the storing portion, at least a part of the imitation is visible through the packing container when the imitation is installed with the installing portion.

2. The packing container according to claim 1, wherein the installing portion has a concave portion for installing the imitation, and at least the concave portion is transparent when viewed in a direction parallel to a direction in which the packing container is installed with the imitation.

3. The packing container according to claim 2, wherein the concave portion is transparent when viewed in a direction orthogonal to the direction in which the packing container is installed with the imitation.

4. The packing container according to claim 1, wherein the main body of the device has a first housing, a second housing and a coupling portion that couples the first housing and the second housing to each other, and the cover includes a first cover that constitutes a first part of the first housing or covers the first part and a second cover that constitutes a second part of the second housing or covers the second part, and the storing portion stores the first cover and the second cover while arranging the first cover and the second cover at an interval of a width corresponding to a width of the coupling portion.

5. The packing container according to claim 4, wherein the packing container is transparent at least at the interval when viewed in a direction parallel to a direction in which the packing container is installed with the imitation.

6. The packing container according to claim 4, wherein upper and lower portions of the first cover and the second cover arranged in the vertical direction are transparent when viewed in a direction parallel to a direction in which the packing container is installed with the imitation.

7. A cover package including a cover that one of (a) constitutes a part of a main body of a device or (b) covers the part of the device and a packing container that packs the cover, wherein the packing container comprises a storing portion that stores the cover and an installing portion configured to install the cover packing to an imitation that imitates at least a part of the device and that is external to the cover package, and an area of the cover package other than an area storing the cover is transparent through the cover package so that while the cover is stored in the storing portion at least a part of the imitation is visible when the imitation is installed in the installing portion.

8. A packing container configured to pack a cover that one of (a) constitutes a part of a main body of a device or (b) covers the part of the main body, the packing container comprising:

a storing portion configured to store the cover; and an installing portion configured to install the packing container to an imitation that imitates at least a part of the device, wherein at least a part of an area of the packing container other than an area storing the cover is transparent through the packing container so that when the cover is stored in the storing portion, at least a part of the imitation is visible through the packing container when the imitation is installed with the installing portion, the main body of the device has a first housing, a second housing and a coupling portion that couples the first housing and the second housing to each other, and the cover includes a first cover that constitutes a first part of the first housing or covers the first part and a second cover that constitutes a second part of the second housing or covers the second part, and the storing portion stores the first cover and the second cover while arranging the first cover and the second cover at an interval of a width corresponding to a width of the coupling portion.

9. The packing container according to claim 8, wherein the packing container is transparent at least at the interval when viewed in a direction parallel to a direction in which the packing container is installed with the imitation.

10. The packing container according to claim 8, wherein upper and lower portions of the first cover and the second cover arranged in the vertical direction are transparent when viewed in a direction parallel to a direction in which the packing container is installed with the imitation.

11. A packing container configured to pack a cover that one of (a) constitutes a part of a main body of a device or (b) covers the part of the main body, the packing container comprising:

an interior volume configured to store the cover; and an exterior structure that is configured to mate the packing container with an imitation that imitates at least a part of the device and that is external to the packing container, wherein at least a part of an area of the packing container other than an area corresponding to the interior volume is transparent through the packing container so that when the cover is stored in the interior volume at least a part of the imitation is visible through the packing container when the imitation is mated with the installing portion.

12. The packing container according to claim 11, wherein the exterior structure has a concave surface for installing the imitation, and at least a material that forms the concave surface is transparent when viewed in a direction parallel to a direction in which the packing container is installed with the imitation.

13. The packing container according to claim 12, wherein the material that forms the concave surface is transparent when viewed in a direction orthogonal to the direction in which the packing container is installed with the imitation.

14. The packing container according to claim 11, wherein the main body of the device has a first housing, a second housing and a coupling structure that couples the first housing and the second housing to each other, and the cover includes a first cover that constitutes a first part of the first housing or covers the first part and a second cover that constitutes a second part of the second housing or covers the second part, and the interior volume stores the first cover and the second cover while arranging the first cover and the second cover at an interval of a width corresponding to a width of the coupling structure.

15. The packing container according to claim 14, wherein the packing container is transparent at least at the interval when viewed in a direction parallel to a direction in which the packing container is installed with the imitation.

16. The packing container according to claim 14, wherein upper and lower portions of the first cover and the second cover arranged in the vertical direction are transparent when viewed in a direction parallel to a direction in which the packing container is installed with the imitation.

* * * * *